United States Patent [19]

Shannon, Jr.

[11] Patent Number: 4,638,998

[45] Date of Patent: Jan. 27, 1987

[54] SINGLES STICK FOR NET HEIGHT ADJUSTMENT

[76] Inventor: John L. Shannon, Jr., 13297 Cardinal Creek Dr., Eden Prairie, Minn. 55344

[21] Appl. No.: 725,359

[22] Filed: Apr. 19, 1985

[51] Int. Cl.[4] ..... A63B 71/02

[52] U.S. Cl. ..... 273/29 BB

[58] Field of Search ..... 273/29 BA, 29 B, 413, 273/14, 5 R, 29 BC, 29 BE, 20; 272/101, 103; 108/131, 132

[56] References Cited

U.S. PATENT DOCUMENTS

| | | | |
|---|---|---|---|
| 451,938 | 5/1891 | Klapperich | 273/20 |
| 1,224,388 | 5/1917 | Lane | 273/29 BE |
| 3,262,703 | 7/1966 | Lodlick | 273/413 |
| 3,549,146 | 12/1970 | Davis | 273/29 B |
| 4,010,951 | 3/1977 | Gronlund | 273/29 BC |
| 4,065,125 | 12/1977 | Chan | 273/5 R |
| 4,291,875 | 9/1981 | Smith, Jr. | 273/29 B |
| 4,440,393 | 4/1984 | Smith, Jr. | 273/29 BB |

*Primary Examiner*—Richard C. Pinkham
*Assistant Examiner*—T. Brown
*Attorney, Agent, or Firm*—James W. Miller

[57] ABSTRACT

An improved net height adjustment device (20) or (70) includes an elongated stick member (22) for raising the top edge of an athletic net (10) from its otherwise undisturbed orientation to convert a tennis net from doubles to regulation singles play. The device (20) or (70) includes a support member (42) for pivotally connecting the stick member (22) to one of the end posts (14) that support the net (10). Support member (42) also includes an extensible connection that allows stick member (22) to be pulled out away from a storage position adjacent post (14) to a use position spaced from the post.

14 Claims, 7 Drawing Figures

SINGLES STICK FOR NET HEIGHT ADJUSTMENT

TECHNICAL FIELD

This invention relates to an elongated stick for adjusting the height of an athletic net above the ground. More particularly, this invention relates to a so-called singles stick used in tennis to reset the net height from that appropriate for doubles play to that required for singles play.

BACKGROUND OF THE INVENTION

Tennis is a well known game played on a generally standardized court. The tennis court usually comprises a rectangular playing area bounded by two spaced apart end lines which are connected together by side lines. In fact, each side of the tennis court is usually provided with two parallel side lines, a singles line used for singles play and a doubles line used for doubles play, i.e. when either one or two players are playing together on the same side, respectively. This playing area is bisected across the middle thereof by the tennis net. The tennis net can have various forms, but customarily includes a net strung under tension between two relatively permanent end posts. These posts are most often set at a location outside of the doubles line on the court.

Under the formal rules of tennis, as set out by the various governing bodies thereof, the tennis net must have a particular height at various points along its length. For example, the low point of the tennis net is usually at the center thereof where it is cinched by a strap fixed to the court to attain the correct height. The net slopes gradually upwardly from this center point until it reaches the other support points for the net, namely the end posts. As a practical matter, the height of the end posts is chosen so that when the net crosses the doubles line it will have the correct height above the ground to satisfy the rules of play for doubles. Unfortunately, this same net orientation used for doubles play does not work for singles play since the height of the net as it crosses the singles line is too low.

Because it is most desirable to have a single tennis court that can be used for both singles and doubles play, the problem for adjusting the tennis net to regulation height for singles play has been solved by using what is known as a singles stick. This stick is simply an elongated member or board having a notch in the top which is jammed between the tennis net and the ground. This is usually done at a predetermined location outside the singles court with the singles stick being of a sufficient height so that it will raise the top of the net the amount necessary to convert it to regulation singles play, i.e. the height of the net above the ground at the singles line will be exactly correct. Thus, most tennis courts are built with the end posts and the net normally being set for doubles play with singles sticks being used when necessary to convert to regulation singles play.

While singles sticks are effective for the purpose for which they are intended, namely converting the net from doubles to singles play, they have a number of disadvantages. For one thing, they are somewhat difficult to properly place requiring a fairly exact measurement to determine the proper location on the court for placing the singles stick, i.e. the distance which the singles stick should be placed outside the singles court. While marks could be placed on the court's surface to aid this location, such marks disappear over time and the users of the singles sticks are often forced to simply measure each time the singles stick is used. When a court is frequently converted from singles to doubles play, the need for precise measurement is a nuisance. Moreover, most conventional singles sticks are simply jammed between the net and the ground and are thus prone to being struck by stray tennis balls and dislodged. This of course requires a remeasurement and reinsertion of the singles stick. Finally, and perhaps most importantly, singles sticks are very easily lost as are all pieces of unattached equipment. Thus, whenever it is desired to play regulation singles, it may be difficult, if not impossible, to find singles sticks at the club or location at which one is playing. Moreover, at a public court, where such singles sticks would not ordinarily be kept, each group of tennis players would usually have to bring their own sticks to be sure of having them on hand.

Applicant is aware of some patents relating to improved singles sticks, namely U.S. Pat. Nos. 4,291,875 and 4,440,393 to Smith. These patents disclose a singles stick split into two parts so that the stick can be placed on opposite sides of the tennis net and bolted together using suitable fasteners. This enables the singles stick to more securely grip the net, and thus not be as prone to being dislodged by stray balls, and also seeks to raise the net height without in any way deforming the net from its vertical plane. However, such a singles stick would have to be removed from the net to reconvert it to doubles play and as such is as prone to being lost as are the other prior art sticks. Moreover, precise measurement and installation is required each time the singles stick is to be used. Finally, this singles stick would take even more time to install and remove than the others shown in the prior art, which simply require a wedging action between the tennis net and the ground, since various threaded fasteners such as wing nuts must be secured.

SUMMARY OF THE INVENTION

The present invention relates to an improved mechanism, often in the form of an attachment, for adjusting the height of an athletic net strung between two spaced posts. This mechanism comprises an elongated stick member capable of being placed between the ground and the top edge of the net for raising the top edge of the net above the line it would normally occupy in an undeformed orientation. A means is provided for storing this stick on one of the end posts so that it will always be convenient for use.

Another aspect of this invention is a stick of the type noted which also includes means for relatively permanently connecting the elongated stick to the post. Such a connecting means is extensible to allow the stick to be moved from a storage position adjacent the post to a use position located inwardly from the post for placement of the stick between the net and the ground. The connecting means may also be pivotably secured to the end post to allow the stick to be swung toward and away from the plane of the net.

BRIEF DESCRIPTION OF THE DRAWINGS

The present invention will be described in more detail hereafter in the following Detailed Description, when taken in conjunction with the following drawings, in which like reference numerals refer to like elements throughout.

DETAILED DESCRIPTION

Figure 1:
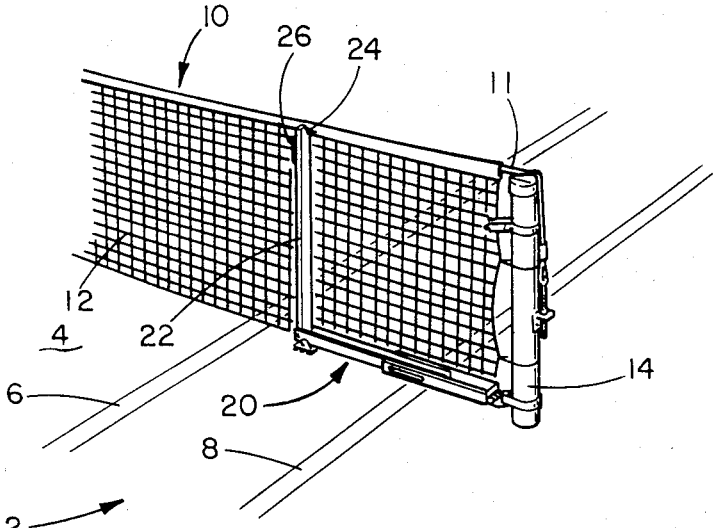
FIG. 1 is a perspective view of a first embodiment of an improved singles stick or athletic net height adjustment mechanism according to this invention, particularly illustrating the stick in its use position spaced inwardly from the end post and wedged between the ground and the net for raising the height of the tennis net for regulation singles play.

Referring first to FIG. 1, a generally conventional tennis court is illustrated at 2. Court 2 includes a playing surface 4 each side of which includes two parallel side lines that mark the court's width, i.e. a singles line 6 and a doubles line 8. A tennis net 10 comprises a top support cord or cable 11 from which the mesh-like net fabric 12 is suspended. Net 10 is strung between two spaced apart and generally circular end posts 14 (only one of which is shown in the drawings) in such a manner that it bisects the playing surface 4 into two equal halves. Each end post 14 is permanently mounted into the ground and is usually located outside the doubles line 8 as shown. A tensioning mechanism 16 may be included on each end post 14 for tightening net 10. In fact, cable 11 of net 10 is usually under considerable tension.

A first embodiment of an improved singles stick or athletic net height adjustment device according to this invention is shown in FIG. 1 generally as 20. Adjustment device 20 includes an elongated stick member 22, known generally as a singles stick in tennis, formed as a planar board. A V-shaped notch 24 is placed into the upper end of stick member 22 for receiving the elongated cable 11 which defines the top edge of net 10. In addition, a handle 26 is located on stick member 22 adjacent the top thereof to allow an operator to manipulate it. The purpose of stick member 22 is to be wedged between cable 11 and the ground to raise the height of the top edge of net 10 above the line that it would normally occupy in an undeformed orientation. When stick member 22 is of the right height, and when it is precisely located inwardly from end post 14 on which net 10 is supported, it will raise the height of net 10 exactly the right amount to convert the net from doubles play height to regulation singles play height.

Figure 3:
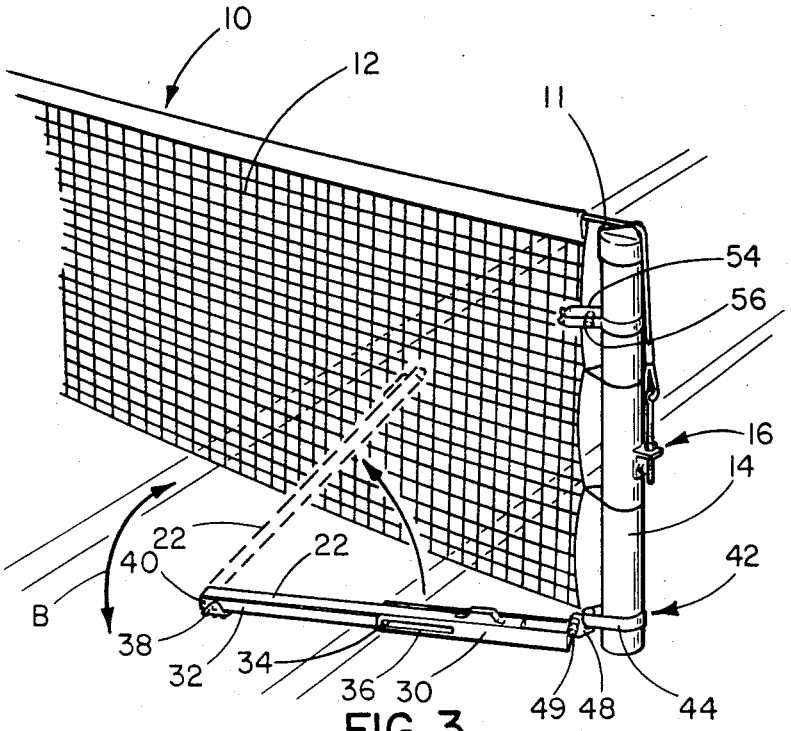
FIG. 3 is a perspective view of the singles stick shown in FIGS. 1 and 2, in a view generally similar to that in FIG. 2, showing the singles stick in a further intermediate position as it is being pulled out between its storage and its use position.
Figure 2:
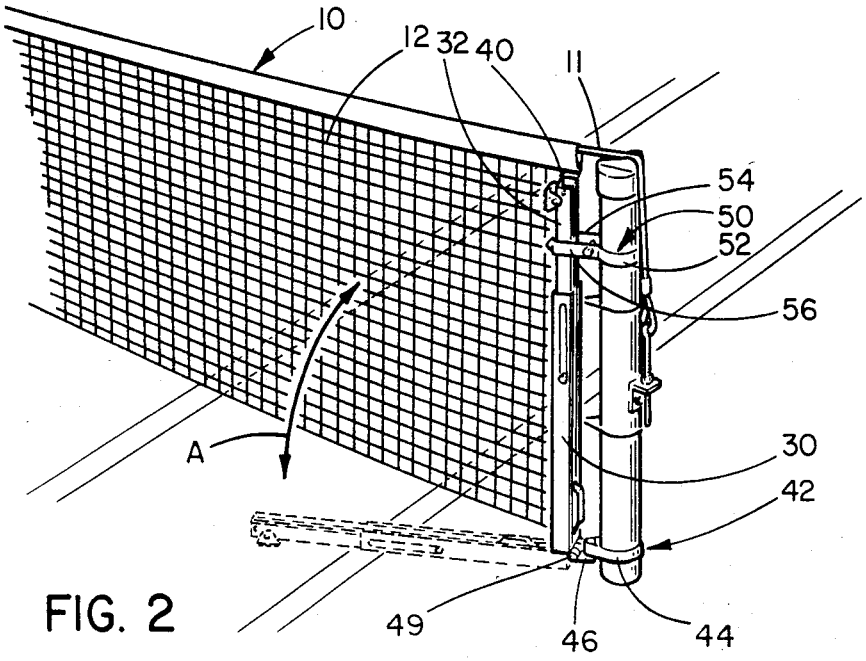
FIG. 2 is a perspective view of the singles stick shown in FIG. 1, particularly illustrating the singles stick in its storage position adjacent the end post and in an intermediate position where it is being pulled out between the storage and use positions.
Figure 4:
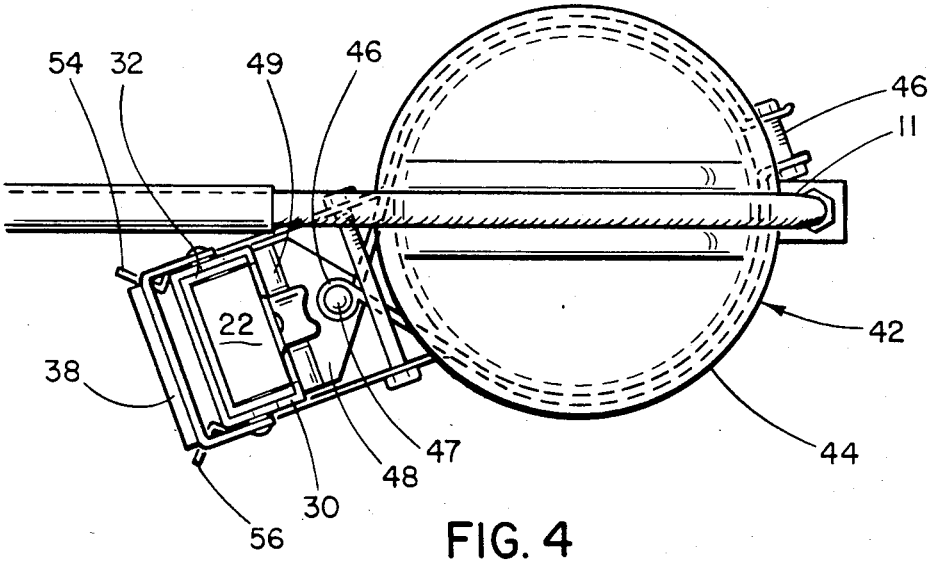
FIG. 4 is a top plan view of the singles stick shown in FIGS. 1 and 2, particularly illustrating the stick in its storage position.

In any event, adjusting device 20 also includes a means for extensibly connecting stick member 22 to end post 14 for movement between a storage position adjacent post 14, as shown in FIG. 2, and a use position spaced inwardly from post 14, as shown in FIG. 1. In FIGS. 1-4, this connecting means comprises two telescopic rails 30 and 32. The first rail 30 is pivotably secured to a support member 42 on post 14. The second rail 32 is telescopically received in first rail 30 and is capable of being slid inwardly and outwardly relative thereto. Second rail 32 includes outwardly extending pins 34 which ride in elongated slots 36 in first rail 30. This pin and slot connection allows the outward movement of second rail 32 to be regulated so that it can only be pulled out a certain extent, i.e. until the pins 32 engage the outer end of slots 36. See FIG. 3. In addition, the second rail 32 also includes a rubber foot 38 or the like capable of being placed against the playing surface 4 of the tennis court to protect the court from damage. Finally, each rail 30 and 32 is formed as an upwardly opening, U-shaped channel. Stick member 22 is connected by a pivot pin 40 to the outer end of second rail 32 and is sized to fit within the channels forming the rails. Thus, stick member 22 can be folded down to be flat within the rails 30 and 32, but can be pivoted around pivot pin 40 to be released therefrom, as shown in FIG. 3.

A support member 42 is located around the lower end of post 14 and comprises a circular strap-like clamp 44 tightened by a bolt-type fastener 46 to rigidly clamp the post. Clamp 44 includes a hinge-like protrusion 46 which rotatably journals a vertical pivot pin 47 that is secured to a horizontal support flange 48. Flange 48 is itself connected by a horizontal hinge 49 to the inner end of first rail 30. Thus, rails 30 and 32, and with them stick member 22, may be pivoted around hinge 49, as shown by the arrows A in FIG. 2, from a vertical position adjacent end post 14 to a horizontal position substantially flat on playing surface 4. In addition, this whole structure may be swung toward and away from the plane of the net by pivoting it around the pivot axis defined by pivot pin 47, as shown by the arrows B in FIG. 3. This allows the stick member 22 and rails 30 and 32 to be "set up" while spaced from the net and then swung into engagement with the net.

Finally, adjustment device 20 also includes adjacent the top of end post 14 a retaining means 50 for holding device 20 in a storage position adjacent post 14. Retaining means 50 comprises a clamp 52 having two spaced spring arms 54 and 56. Spring arms 54 and 56 are located and spaced apart sufficiently far so that they can clamp onto the outside of second rail 32 when device 20 is in its storage position. See FIGS. 2 and 4.

Referring now to FIG. 2, device 20 is shown in a normal storage position ready for use. In such a position, spring arms 54 and 56 of clamp 52 have grabbed onto the second rail 32 with that rail 32 being collapsed down into the first rail 30 and with stick member 22 being nested into the rails. Device 20 can be retained in this manner until it is needed to raise the height of the net to convert from doubles to singles play. Then, all the player needs do is to walk up to the mechanism and unclamp the rail structure from spring arms 54 and 56 and rotate it downwardly 90° until the rails 30 and 32 are lying flat against the ground. See, for example, the dotted line illustration in FIG. 2 which illustrates the mechanism after it has been rotated downwardly into engagement with the ground.

Then, the operator needs to pull out or extend the rail structure by pulling out the second rail 32 from first rail 30 until it reaches the "fully extended" position shown in solid lines in FIG. 3. Then, the operator places his hand into the handle 26 on stick member 22 and pivots stick member 22 upwardly to raise stick member 22 outside of the rails. Stick member 22 is now ready to be placed between the net cable 11 and the ground. To do so the entire structure is pivoted slightly around the vertical pivot axis of pivot pin 47 until stick member 22 is in the plane of net 10. Net 10 can be lifted until cable 11 rests in notch 24. The tension on cable 11 will thus force stick member 22 down firmly into engagement with the ground. After this is done, net 10 has been raised to a height appropriate for regulation singles play.

The adjustment device 20 of this invention has numerous advantages over prior art singles sticks. For one thing, stick member 22 is always attached to the end post 14 after it has been installed thereon and is always ready for use. Thus, the problem of the singles stick being lost or unavailable is not present, nor do the players have to bring singles sticks with them to the court. Moreover, the length of rails 30 and 32 when fully extended is chosen so that stick member 22 will always be located precisely the right length inwardly from the end post 14. Thus, there is no need to precisely measure in from the post or doubles line to locate the singles stick. All the operator has to do is pull the extensible members out and stick member 22 will automatically be located in the proper position. Moreover, the downward tension on the net is sufficiently strong in conjunction with rails 30 and 32 to keep stick member 22 in place. In this regard, the extended rails 30 and 32 act as a brace and their bracing effect could be enhanced by providing any suitable means (not shown) for locking them in their fully extended positions. For example, frictional retaining means or a locking pin placed through aligned holes in the rails could be used. Thus, stick member 22 is much less prone to being dislodged by balls than those prior art singles sticks which were simply wedged between the ground and the net.

Figure 6:
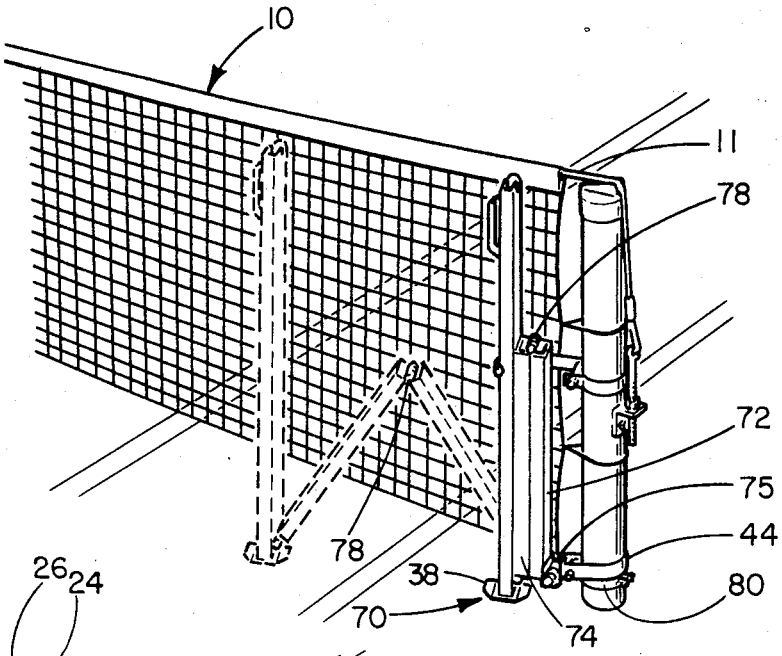
FIG. 6 is a perspective view of the singles stick shown in FIG. 5, particularly illustrating the singles stick in its storage position adjacent the end post and in an intermediate position between its storage and use positions.
Figure 5:
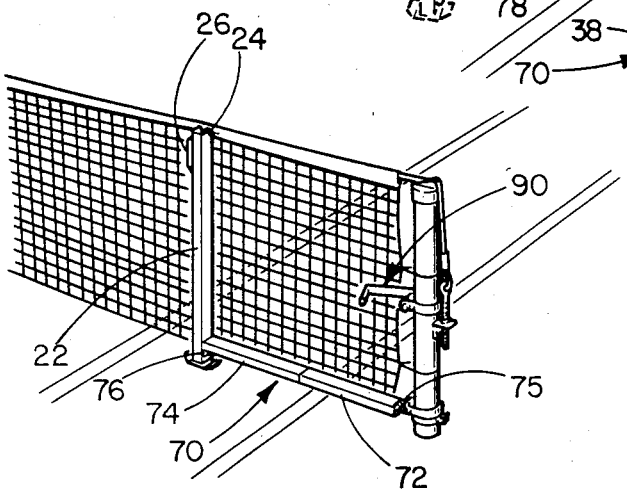
FIG. 5 is a perspective view of a second embodiment of an improved singles stick or athletic net height adjustment mechanism according to this invention, particularly illustrating the stick in its use position spaced inwardly from the end post and placed between the ground and net for raising the height of the tennis net for regulation singles play.
Figure 7:
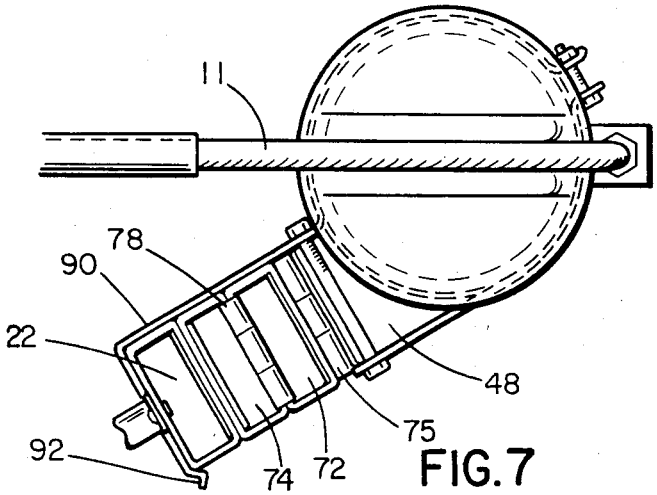
FIG. 7 is top plan view of the singles stick shown in FIG. 5, particularly illustrating the stick in its storage position.

A second embodiment of an improved singles stick or athletic net height device according to this invention is illustrated in FIGS. 5–7 generally as 70. Adjustment device 70 is generally similar to that device 20 just described in that it includes an elongated singles stick member 22 having a notch 24 at the top which receives net cable 11, the stick member 22 being wedged between the ground and the net for raising the height of the net. It is also similar in that it is relatively permanently attached to the end post after installation so as to be always convenient and it includes an extensible connecting means to the end post which automatically sets stick member 22 inwardly from the end post at the right distance when extended. It differs primarily from device 20, however, in the precise type of extensible connecting means used, and also in the means for pivotably connecting the structure to post 14.

In the device 70 according to the second embodiment, the extensible connecting means comprises a an accordian-like structure having first and second legs 72 and 74 pivoted at their ends at 75 and 76 to end post 14 and stick member 22, respectively. Legs 72 and 74 are also pivotably connected by a hinge 78 at their ends which join together to allow them to be folded up against one another or extended out end-to-end. In addition, rather than mounting the entire device 70 for pivoting about a separate vertical pivot pin 47, the entire lower clamp 44 is now simply loosely received around end post 14 so that the clamp itself can be pivoted around the post. In this case, it would be desirable to have a second lower collar 80 which is fixedly clamped on end post 14 to serve as a bearing support for the pivotable clamp.

As shown in FIGS. 5–7, in device 70 according to the second embodiment, stick member 22 is always vertical and is not nested within telescopic rails. It is normally retained in its storage position closely adjacent end post 14 by an L-shaped clamp arm 90 which comes out and serves as a stop against which the stick 22 is secured. Clamp arm 90 includes a protrusion 92 at its free end to frictionally retain device 70 thereagainst. See FIG. 7. In addition, a strap or the like (not shown) can also be used to further retain stick member 22 within this L-shaped clamp arm 90. In any event, when it is desired to use the singles stick, stick member 22 is first released from the clamp arm 90 by slightly pivoting it outwardly to clear the arm. Then, it is simply pulled straight out from the post which causes the accordian-like hinge structure to extend and eventually become flat. See FIGS. 5 and 6. When it is fully extended, as shown in FIG. 5, stick member 22 can then be pivoted back inwardly toward the net (by virtue of the pivoting ability of clamp 44) to locate the singles stick under the net and engage the same to raise the net height. In this case, the court engaging foot 38 is provided on the lower end of stick member 22 itself since the legs 72 and 74 of the accordian-like hinge structure do not engage the ground. In addition, legs 72 and 74 are far enough above the ground to allow the user to place his foot beneath leg 74 and kick upwardly to begin collapsing the legs from their fully extended position to their folded up position, i.e. after use of device 70 and when it is desired to store stick member 22. A small kick plate in the shape of a flat piece of metal could also be placed on top of leg 74 near stick member 22 to provide another bearing surface for the user's foot when collapsing legs 72 and 74.

Various other modifications of this invention will be apparent to those skilled in the art. Thus, the scope of this invention is to be limited only by the appended claims.

I claim:

1. An attachment for a post which supports one end of an athletic net, which comprises:

(a) an elongated stick member having a height which is sufficiently long so that the stick member is capable of being wedged between a top edge of the net and the ground to raise the top edge of the net from its otherwise undisturbed orientation;

(b) means for releasably storing the stick member on the post so that the stick member is convenient for use, (c) means for extensibly connecting the stick member to the post so that the stick member may be pulled toward or away from the post after release therefrom; and (d) means responsive to movement of the stick member away from the post for limiting the extension of the connecting means to a predetermined distance in an operative position thereof which is selected in conjunction with the height of the stick member to raise the height of the net a precise amount at a particular point along its span, whereby the net may be accurately adjusted without having to manually measure the location of the stick member relative to the post.

2. An attachment as recited in claim 1, wherein the storing means comprises opposed spring arms carried on the post for releasably clamping the stick member to the post.

3. An attachment as recited in claim 1, wherein the limiting means comprises an extensible connecting means having a predetermined length when fully extended so that the stick member will be located at a predetermined distance inwardly from the post.

4. An attachment for a post which supports one end of an athletic net, which comprises:

(a) an elongated stick member having a height which is sufficiently long so that the stick member is capable of being wedged between a top edge of the net and the ground to raise the top edge of the net from its otherwise undisturbed orientation;

(b) means for releasably storing the stick member on the post so that the stick member is convenient for use; and (c) means for extensibly connecting the stick member to the post so that the stick member may be pulled toward or away from the post after release therefrom, wherein the extensible connecting means comprises first and second rail members telescopically secured to one another for movement from retracted to fully extended positions, wherein the first rail member is connected to the post and the second rail member is connected to the stick member.

5. An attachment as recited in claim 4, wherein the rail members comprise upwardly opening U-shaped channels, and wherein the stick member is pivotally secured to the second rail member and is sized to fit within the channels of the rail members.

6. An attachment as recited in claim 4, wherein the first rail member is pivotably secured to the post to allow the stick member to be swung toward and away from the plane of the net.

7. An attachment as recited in claim 4, wherein the first and second rail members have a predetermined length when placed in their fully extended position so that the stick member will be located at a predetermined distance inwardly from the post.

8. An improved mechanism for adjusting the height of an athletic net, which comprises:

(a) an athletic net extending in a plane and strung between two end posts;

(b) an elongated stick stored adjacent each of the two end posts in a position offset from the plane of the net;

(c) a support member for pivotably securing each stick to the post for movement toward and away from the plane of the net; and (d) means for extensibly connecting the sticks to the support members to allow each stick to be pulled away from its respective post in a plane offset from the plane of the net and wedged between the net and the ground after extension thereof.

9. An improved mechanism as recited in claim 8, wherein the end posts are substantially circular and each support member comprises a substantially circular collar sized to be received over the end posts.

10. An improved mechanism as recited in claim 9, wherein the extensible connecting means is pivotably secured on the end post by the collar and the stick is carried by the extensible connecting means.

11. An improved mechanism as recited in claim 10, wherein the collar is loosely received around the end post so as to be pivotal relative thereto.

12. An improved mechanism as recited in claim 10, wherein the collar is rigidly fixed to the end post and includes a vertical pivot pin for pivotably journalling the connecting means and stick thereto.

13. An attachment for a post which supports one end of an athletic net, which comprises:

(a) an elongated stick member having a height which is sufficiently long so that the stick member is capable of being wedged between a top edge of the net and the ground to raise the top edge of the net from its otherwise undisturbed orientation;

(b) means for releasably storing the stick member on the post so that the stick member is convenient for use; and (c) means for extensibly connecting the stick member to the post so that the stick member may be pulled toward or away from the post after release therefrom, wherein the extensible connecting means comprises first and second legs which are hinged together at one end to be capable of being moved from a collapsed to a fully extended position.

14. An attachment as recited in claim 13, wherein the first and second legs have a predetermined length when placed in their fully extended position so that the stick member will be located at a predetermined distance inwardly from the post.

* * * * *